United States Patent [19]

Hashimoto et al.

[11] 3,989,389

[45] Nov. 2, 1976

[54] MULTI-COLOR MECHANICAL WRITING INSTRUMENT

[75] Inventors: Yasuyuki Hashimoto, Nishinomiya; Osamu Torii, Kyoto, both of Japan

[73] Assignee: Ancos Co., Ltd., Osaka, Japan

[22] Filed: Aug. 4, 1975

[21] Appl. No.: 601,670

[30] Foreign Application Priority Data

Aug. 22, 1974 Japan ..... 49-96905

[52] U.S. Cl. ..... 401/30

[51] Int. Cl.[2] ..... B43K 5/16

[58] Field of Search ..... 401/29–33, 401/110

[56] References Cited

UNITED STATES PATENTS 2,849,983 9/1958 Gossweiler et al. ..... 401/33

3,700,340 10/1972 Terasaki ..... 401/33

FOREIGN PATENTS OR APPLICATIONS 1,091,233 10/1954 France ..... 401/30

953,116 3/1964 United Kingdom ..... 401/110

*Primary Examiner*—Lawrence Charles

*Attorney, Agent, or Firm*—George B. Oujevolk

[57] ABSTRACT

A multi-color mechanical writing instrument which contains ink tubes or reservoirs, a rotary cam having a blocking section, an inner flange or a stopper which enables a writing tip to be pushed out which is positioned underneath a cam body with a push-bar inside a rear casing, and where the inner surface of the rear casing is shaped in the form of cam walls in order to have the rotary cam turn back and forth along the cam walls with the movement of pushing the push-bar to push the tip of an ink tube out or pull it back alternatively.

3 Claims, 20 Drawing Figures

MULTI-COLOR MECHANICAL WRITING INSTRUMENT

BACKGROUND OF THE INVENTION

This invention relates to a multi-color mechanical writing instrument operated by push action by one hand. Various types of conventional multi-color mechanical writing instruments have been developed. For instance, a conventional multi-color mechanical writing instrument incorporates a plural number of ink tubes or reservoirs arranged in parallel in the casing, and the push-bar placed on top of the respective color ink tubes rotates to have the push-bar positioned on a selected ink tube. When selected for writing, the push-bar is depressed to push a selected color tip out. This conventional type of writing instrument requires an operation to rotate the push-bar or twist a selected color ink tube by using both hands so as to be inconvenient.

Another conventional type of a writing instrument incorporates a plural number of color indentification push-buttons around the outer surface of the casing to push the selected color tip out or pull it back by a pushing operation of the respective color identification button desired, which require additional operations to identify the color desired and set it properly to push the selected tip out by both hands.

OBJECTS OF THE INVENTION

An object of this invention is to provide a simple device to operate the multi-color mechanical writing instrument.

Another object of this invention is to provide a simple and convenient multi-color mechanical writing instrument operated by pushing the push-bar to push the tip out in various colors alternatively in turn.

Still another object of this invention is to provide a multi-color mechanical writing instrument composed of a plural number of writing units or ink tubes in one compact casing.

SUMMARY OF THE INVENTION

Generally speaking, the present invention contemplates a multi-color mechanical writing instrument composed of ink tubes, a rotary cam having a blocking section or stopper, which is pushed toward the tip by pushing a push-bar in order to push the tip of an ink tube or reservoir out for writing purposes, or to have said rotary cam retreat by pushing the push-bar again to pull the tip back. This movement is repeated by pushing the push-bar again.

In this specification, a writing instrument is understood to mean a ball-point pen, a marker pen or other type of writing instrument.

These and other objects of this invention will be apparent from the following description of the invention with reference to the accompanying drawings, in which:

DETAILED DESCRIPTION

The writing instrument contemplated herein is generally shown in FIGS. 1 to 5.

Figures 1, 2, 3, 4, 5:
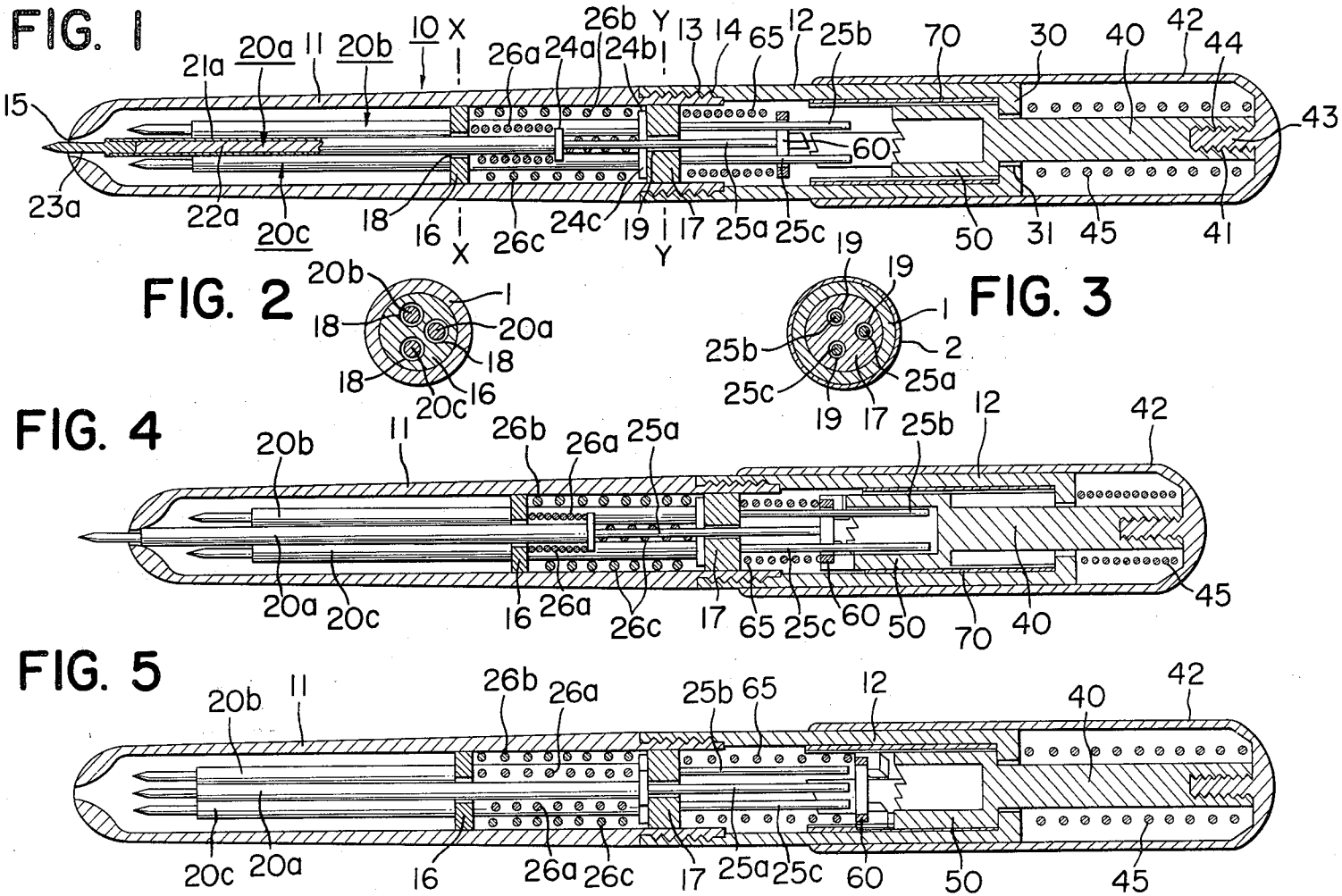
FIG. 1 is a cut-away view mainly showing a multi-color mechanical writing instrument, i.e., a ball-point pen relating to this invention.
FIG. 2 is a sectional view showing a cut-away section along line X — X shown in FIG. 1.
FIG. 3 is a sectional view showing a cut-away section along line Y — Y shown in FIG. 1.
FIG. 4 is a sectional view of a multi-color mechanical writing instrument in use, at one time period.
FIG. 5 shows a view similar to FIG. 4, but at another time period.

The structure shown on FIG. 1 consists of a barrel having a front casing 11 and a rear casing 12. One end of the casing 11 is removable and has a screw thread 13 and one end of the other casing 12 has a screw thread 14 for receiving screw thread 13 so that the two casings 11 and 12 will form one unit. One end of front casing 11 is pointed having a small hole 15 for the ink tube or reservoir which will project or retract by pushing the push-bar 40. Inside a front casing 11, a front disc 16 and a rear disc 17 are contained forming a cylindrical body. These front and rear discs have a plural number of holes 18, 19 as shown in FIG. 2 and 3.

As shown by FIG. 2, the ink tubes 20*a*, 20*b*, 20*c*, come through the respective holes 18.

The ink tube 20*a* consists of the tube 21*a*, the ink reservoir 22*a* and the writing tip 23*a*, and is inserted into one end of the tube 21*a*.

The tubes 20*a* and 20*c* are identical in structure. An elongated member or joint 25*a* with a flange stopper 24*a* close to one end of the joint 25*a* is inserted into one end of the tube 21*a*. The same type of joints are used for the ink tubes 20*b* and 20*c*. Coil springs 26*a*, 26*b*, 26*c* are installed spirally between the stoppers 24*a*, 24*b*, 24*c* and a front disc 16. The coil springs 26*a*, 26*b*, 26*c* force the retract action toward a disc 17 to pull back the tip inside the frame or casing. As shown by FIG. 3, each joint 25*a*, 25*b*, 25*c* comes through the holes 19 of a rear disc.

The stoppers 24*a*, 24*b*, 24*c* being forced toward a disc 17 by the force of the coil springs 26*a*, 26*b*, 26*c* will retract to stop against a rear disc 17.

One rear end of a rear casing 12 is formed in the shape of a stopper 30 having a hole into which a push-bar 40 is inserted from the rear.

One top end of push-bar 40 is enlarged to form a cam body 50 which has the function of acting against the stopper 30. The center of the rear end of the push-bar 40 is removable in the form of a threaded receiving means 44, while inside the cap 42 there is an associated screw means 43. Coil spring 45 is disposed spiraly between a stopper 30 and inside a cap 42 in order to effect a pull-back force on cap 42, push-bar 40 and cam body 50.

Figure 6:
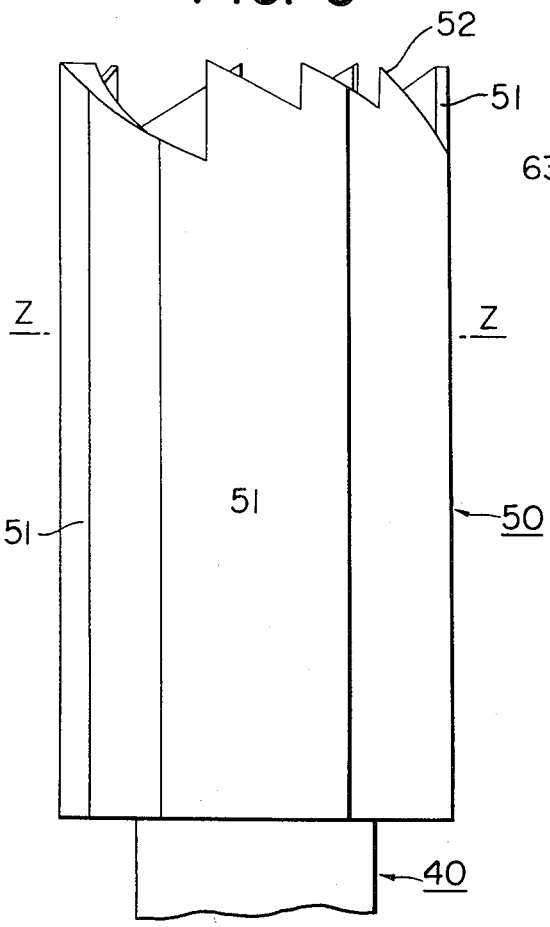
FIG. 6 is a side-view of the cam structure.
Figure 8:
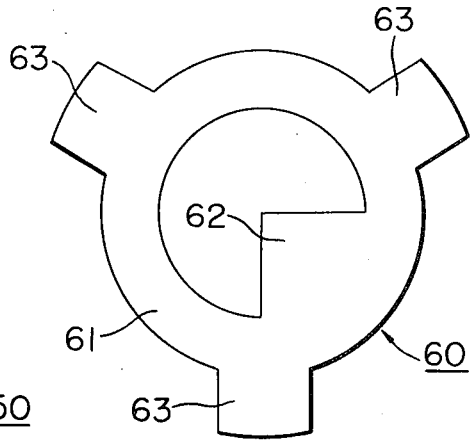
FIG. 8 is a bottom plan view showing a rotary cam.
Figure 9:
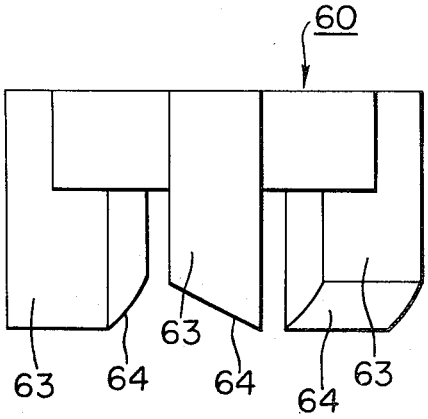
FIG. 9 is a side view of a rotary cam of FIG. 8.
Figure 7:
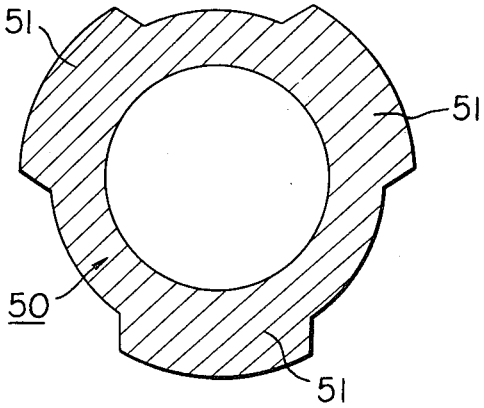
FIG. 7 is a sectional view of the section along line Z — Z in FIG. 6.

The structure of a cam body is shown by FIG. 6 and FIG. 7. FIG. 6 is a side view of a cam body 50. FIG. 7 is a sectional view of the section Z — Z shown by FIG. 6. As shown in FIG. 1, a rotary cam 60 is arranged adjacent to cam body 50. The structure of rotary cam 60 is shown in FIG. 8 and FIG. 9. FIG. 8 is a bottom plan view showing rotary cam 60, and FIG. 9 is a side view showing the same.

As shown by FIG. 8, rotary cam 60 is composed of blocking section 62 inside the center hole of rotary cam 60 and three mounts or ribs 63 around the outer ring of the rotary cam.

As shown in FIG. 9, these cam ribs 63 extend downwards and the ends of these cam ribs 63 form a cam face 64. The coil spring 65 is inserted between a rotary cam 60 and a rear disc 17 to provide back pull or retraction force to pull rotary cam 60 back.

Figure 10:
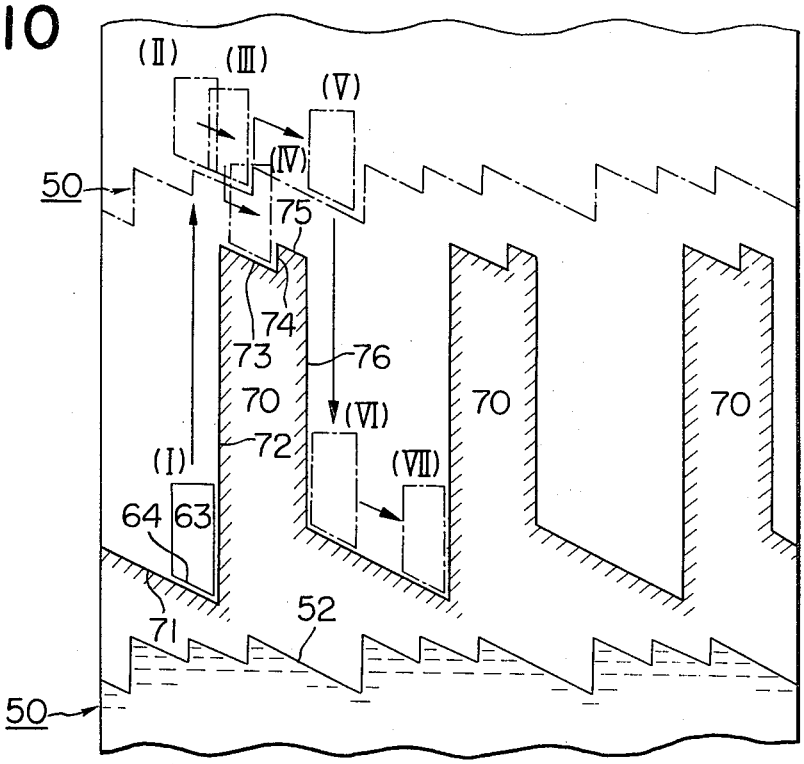
FIG. 10 shows a sectional view of the cam structure in operation and its operational movement in relation with the cam body, the rotary cam and the cam wall.

As shown by FIG. 10, the inner surface of the rear casing is flared out in the form of cam walls 70. The cam wall 70 is composed of a first stop 71, first vertical wall 72, the second stop 73, the second short vertical wall 74, the third stop 75, the third vertical wall 76 and the same cam walls are arranged circularly around the inner surface of rear casing 2. Even though the drawings do not show all the three portions on the cam wall 70, inside, the rear casings are concave and form three vertical shallow depressions or concave portions to guide the cam's edge 9*a*. The depth of the respective depression or concaved portions are made shallow so as to be fitted for sliding the three-side flanges 51. The size of three-side flanges 51 are smaller than the cam ribs 63 of the rotary cam. In other words, the outer circumference of cam body 50 is slightly smaller than that of the rotary cam 60. Although the flanges 51 of the cam body 50 are fitted into the shallow depressions or concaved portions shaped on the cam walls 70 of inner surface of a rear casing 2 so as to slide, the cam rib 63 of a rotary cam 60 will not slide as it is blocked out by the slope of the cam wall. The depressions therefore are so arranged that their function is to have the cam body 50 move back and forth, but not permit a rotating movement of the cam body.

OPERATION OF THE INVENTION

Figure 11:
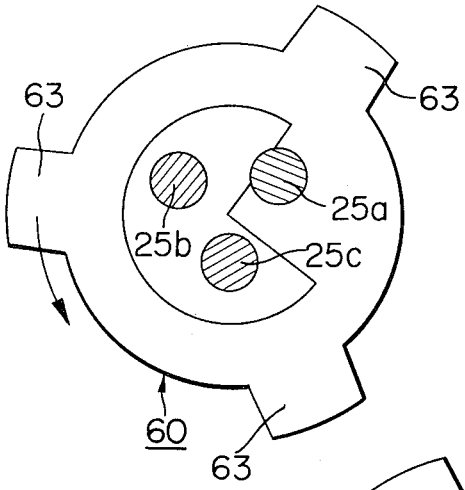
FIG. 11 shows the operational movement of the rotary cam and three ink tubes.
Figure 11:
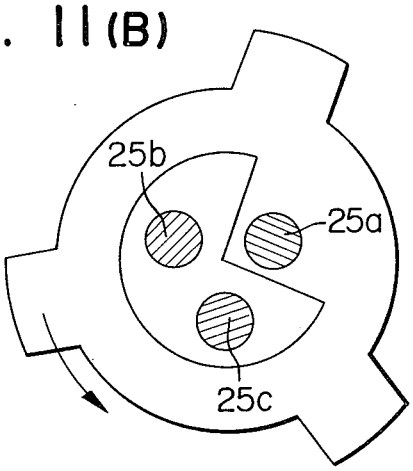
Figure 11C:
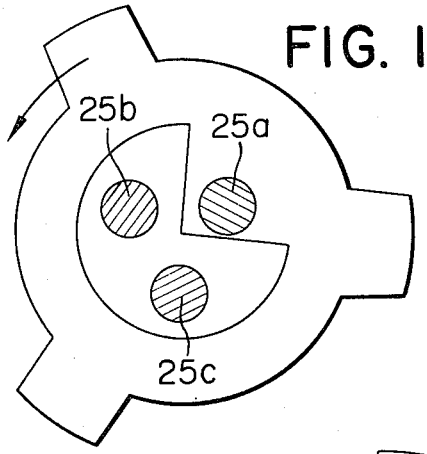
Figure 11D:
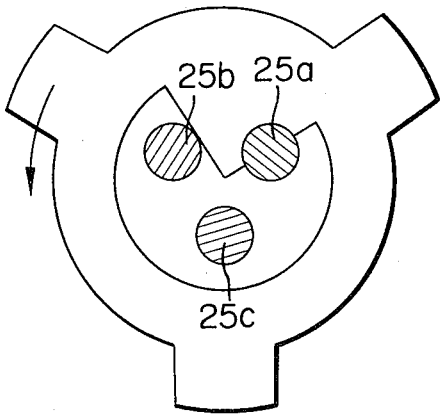
Figure 11E:
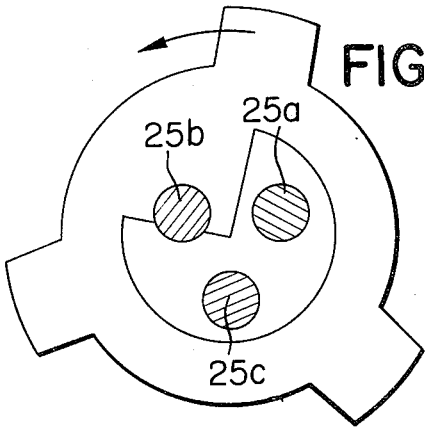

The use and operation for the writing instrument relating to the invention, centers around FIG. 10 and FIG. 11. FIG. 10 shows an operational movement relating to the sawteeth shaped edges 52 of the cam body 50, the cam ribs 63 of rotary cam 60, and the cam walls inside the rear casing 2. FIG. 11 shows an operational movement relating to a rotary cam 60 and the respective joints 25*a*, 25*b*, 25*c*. FIG. 5 shows a retracted status of a push-bar 40, a cam body 50, a rotary cam 60 in operation. FIG. 10 indicates that the cam ribs 63 of rotary cam 60 is in a fully retracted position 1, and a cam body 50 stands by a push-action on the position as indicated by the left bottom portion of FIG. 10. In this condition, the ink tubes 20*a*, 20*b*, 20*c* are all in a fully retracted position. After this, the push-bar 40 is pushed and the three mounts 51 of cam body 50 fit into the depressions formed on the cam walls 70 on the inner surface of rear casing 2 to slide forward along the depressions without rotating. With the sliding of the cam body in the front direction, a rotary cam 60 is advanced, pressing the coil spring 65. The cam ribs 63 of rotary cam 60 is pushed forward along the first vertical wall 72 - this wall plays the role of a guide to cause a slide on the cam wall 70 without rotating of rotary cam 60. In this instance, the position between rotary cam 60 and each joint 25*a*, 25*b*, 25*c* is as shown by FIG. 11 (A). In short, joint 25*a* alone is pressed by blocking section 62 of rotary cam 60 to push the tip out, and joints 25*b*, 25*c* remain inside rear casing 2. Accordingly, joint 25*a* alone is urge forward along with pushed rotary cam 60 to push ink tube 20*a* out of hole 15 of front casing 1 (see FIG. 4). By again urging cam body 50, rotary cam 60 is made to slide forward up to one end of the guide depression to the first vertical wall 72 — a position as shown by FIG. 10 (II) - together with a cam body 50, guided by the first vertical wall guide depression 72, which means that rotary cam 60 is ready to rotate. Since the spring force is acting toward rotary cam 60, the cam face 64 of rotary cam 60 slides clockwise on the face of the sawtoothed shaped cam 52 of cam body 50.

FIG. 10 shows that the cam ribs 63 of rotary cam 60 is moving to position III from position II, and FIG. 11 indicates that the same has moved to condition B from condition A. By releasing the pressing force created by pushing push-bar 40, push-bar 40 will be retracted by spring force. As the rotary cam 60 is forced back by coil spring 65, it is pulled back with a retraction movement of push-bar 40. But, the retraction action of rotary cam 60 is blocked by the second vertical wall 73 of cam wall 70. The cam ribs 63 will slide along the second vertical wall 73 and will stop at a stop position of second vertical wall 74 as shown by FIG. 10; movement is to position IV from position III and rotary cam 60 is rotated slightly to move from condition B to condition C. In other words, this condition of operation indicates that the tip of ink tube 20*a* has been pushed out of hole 15 of front casing 11, as shown by FIG. 4. This makes the writing instrument ready to use for writing.

When ink tube 20*b* has to be retracted, it is necessary to push push-bar cam 40 so as to enable the cam ribs 63 or rotary cam 60 on the second vertical wall 73 to advance with the sawtoothed shaped cam 52 of cam body 50 being pushed. Then, the cam ribs (6) will be unlocked and rotary cam 60 will be in a condition of being able to rotate and slide on the sawtoothed shaped cam 52, moving from position IV to position V as shown by FIG. 10.

Rotary cam 60 moves from condition C to condition D as shown by FIG. 11. When push-bar 40 is pushed to release the pressing force, push-bar 40 is retracted, and the cam ribs 63 of rotary cam 60 will move from position V to position VI as shown by FIG. 10. Also, it will slide on the first slope wall 71 and come at the first vertical wall 72 and stop at position VII.

FIG. 11 shows the operational condition that moves from condition D to condition E. In this condition all ink tubes 20*a*, 20*b*, 20*c* have retreated inside the casing.

Ink tube 25*b* is pushed forward with a blocking section 62 of rotary cam 60 by pushing push-bar 40 in order to push the tip out of a casing. After an ink tube 20*b* has been retracted, another push-action acts so that another tip of an ink tube 20*c* is pushed out. In short, by repeating this operation the respective ink tubes 20*a*, 20*b*, 20*c* will be urged out or retracted one after the other. Therefore, if the respective ink tubes contain different color ink, three different colors of ink can be used by one pen for serving three color writing purposes by following this operation.

Figure 12:
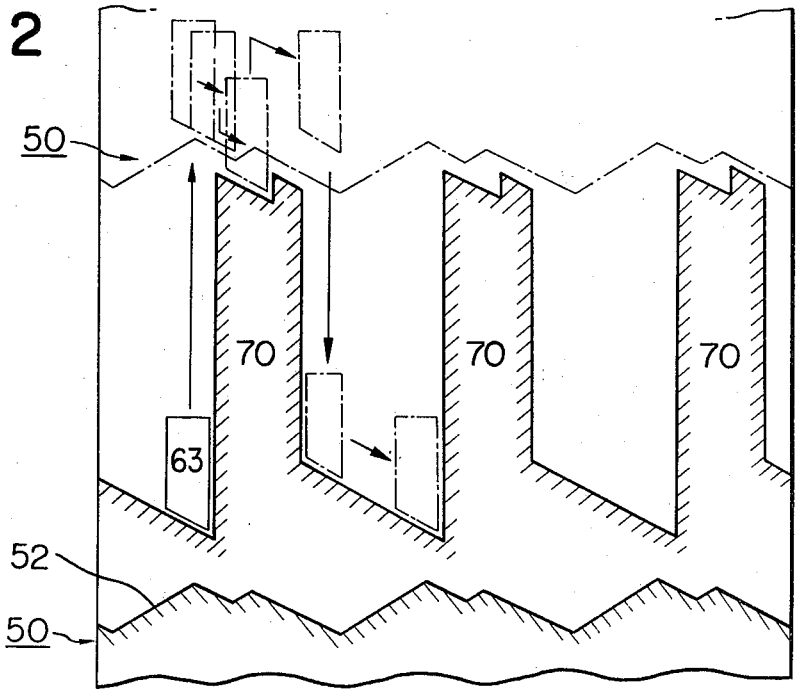
FIG. 12 presents an additional illustration similar to FIG. 10.

FIG. 12 shows another operational example relating to the cam face of cam body 50. As explained heretofore, the sawtoothed shaped cam face of cam body 50, composed of the slope surface and straight surface, slide down on the surface with a smooth inclination angle. Coil spring 45 is necessary to urge push-bar 40 backward.

As shown by FIG. 12, the sawtoothed shaped face of cam body 50 is composed of a gentle slope to make a smooth operation of the cam function.

FIG. 13 through FIG. 16 shows an example of another application centering around the movement of two ink tubes.

Part numbers used on FIG. 13 through FIG. 16 are identical to those of FIG. 1 through FIG. 12.

In these operational examples, shown by FIG. 13 through FIG. 16, ink tubes 20*a*, 20*b* are inserted into the ink tube joints 80*a*, 80*b*, as ink reservoirs. In other words, the ink tubes 20*a*, 20*b* can be replaced through a hole one the top of the pen when the ink is used up. The method of connecting the ink tubes 20*a*, 20*b* with joints 25*a*, 25*b*, respectively, is identical to what has been explained in the first operational example.

Figure 13:
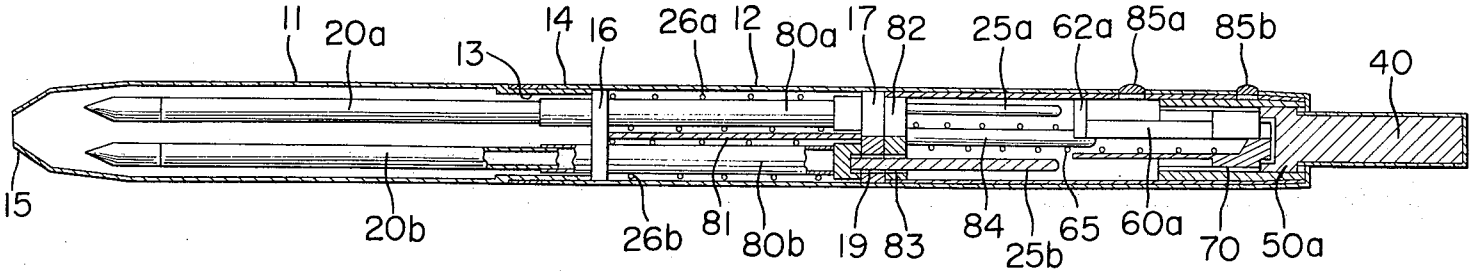
FIG. 13 shows a cut-away view of the pen shown by FIG. 2 in operation at a certain time period.
Figure 14:
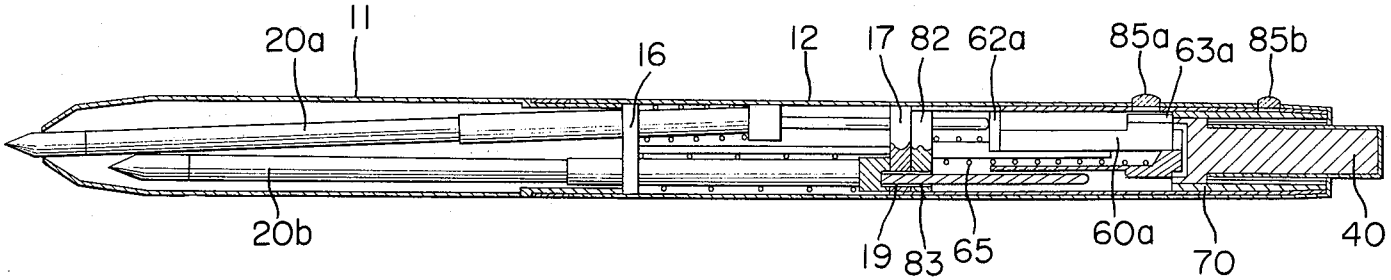
FIG. 14 shows a view similar to FIG. 13 but at another time period.
Figure 15:
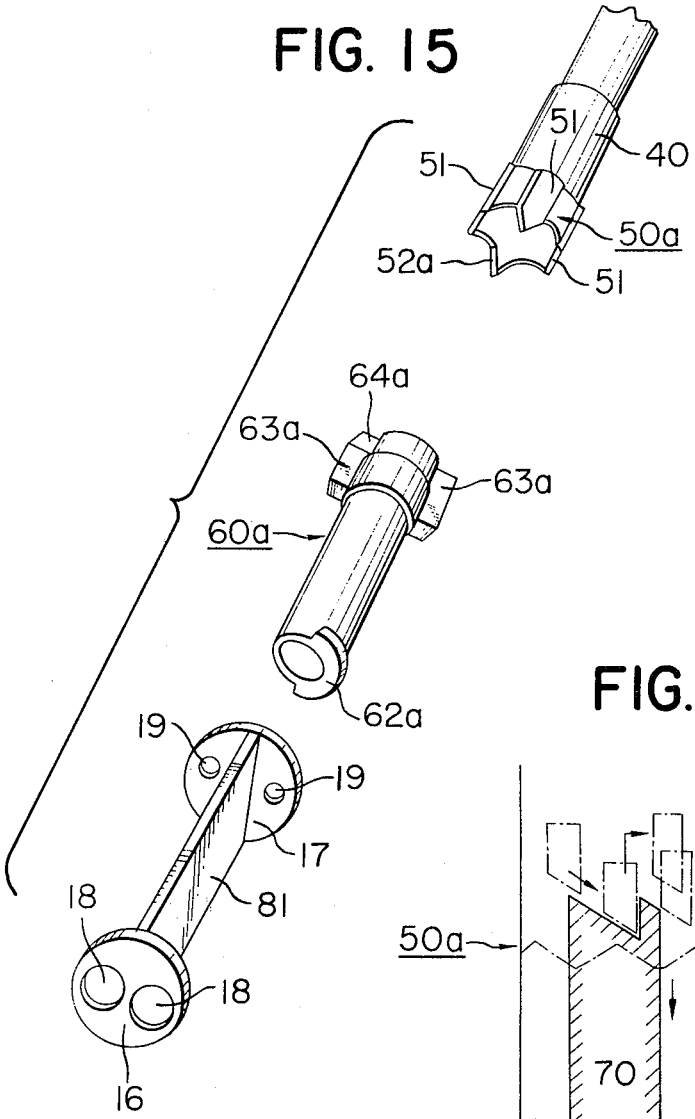
FIG. 15 is a perspective exploded view of a front disc, rear disc and the rotary cam, a cam body shown of FIG. 2 and its structural relations.

A front disc 16 and a rear disc 17 and two side walls 8 form a cylindrical casing for spring 65. It is not necessary to attach this casing to casing 11 or 12 since one end of front disc 16 of the cylindrical case containing the springs will be held on one end of front casing 11 by screw arrangement 6. A disc 82 is firmly held on one side of a rear disc 17 as shown by FIG. 13. This disc 82 has two holes 83 into which two joints 25*a*, 25*b* of the ink tubes pass through.

A thin shaft 84 is firmly fixed on a center of disc 82. The rotary cam shown on two operational examples are different. A rotary cam 60*a* is cylindrical having one open end, and also a semi-eliptical disc 62*a*, or stopper, is disposed on the front end of this rotary cam 60*a*.

The cam ribs 63*a*, have a cam face 64*a* shaped on one rear end of a rotary cam 60*a* and are the same as shown by the first example.

Figure 16:
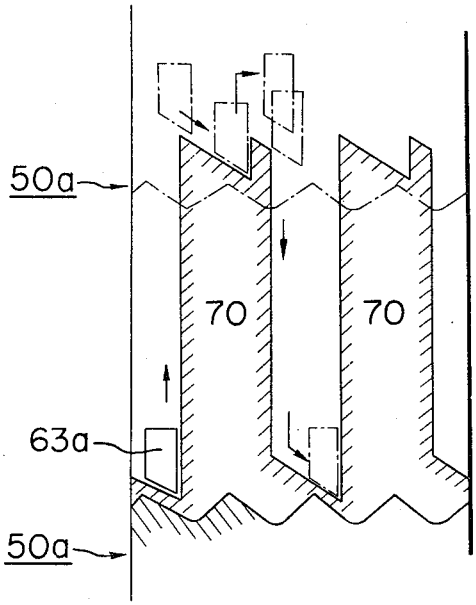
FIG. 16 again shows a sectional view of the cam functions.

In another example, the sawtooth shape 52*a* of cam body 50*a* is formed with gentle edges similar to FIG. 16. This sawtoothed shape will enable a smooth operation of the cam function. A thin shaft 84, attached to the center of disc 82, will come into a hollow section inside rotary cam 60*a*. Spring 65 is coiled spirally around a thin shaft 84 to force the rotary cam 60*a* to pull back.

In these operational examples, a cap 42 is not necessary. The color identification window or vents 85*b* are formed on rear casing 12, and a given portion of the side of rotary cam 60*a* is colored to identify which color is in operation.

FIg. 16 shows the operational movement similar to FIG. 10 and FIG. 12.

Although as an example of this invention, a marker-pen is shown in FIG. 1, FIG. 2, FIG. 3, FIG. 4, FIG. 5, etc., it goes without saying that this invention can be used for ball point pens and other types of pens, and the number of ink tubes can be increased by following the principles herein described.

It is to be observed therefore, that the present invention provides for a multi-colored pen having an elongated casing 1, 2 with a front section, rear section, center section and an outer end, said outer end having an aperture to allow passage of an ink tube tip therethrough. At least first and second elongated ink tubes 20*a*, 20*b* are in said casing with rear ends towards the center section, and tips disposed in the vicinity of said outer end. Flange stopper means 24*a*, 24*b* are located toward said ink tube rear ends, a front disc 16, a rear disc 17 extending across said casing with spring means 26*a*, 26*b* between said stopper means and said front disc 16, biasing said ink tubes to the rear disc 17, thin elongated joint members 25*a*, 25*b* with a joint front and rear ends, each of said joint front ends being attached to one of said ink tube rear ends, rotary cam means 60 in said rear section including a blocking means 62, 62*a*, disposed for contacting said joint rear ends to individually depress one of said joint rear ends to push out the ink tube to which said joint is attached, and outer cam ribs 63 with cam faces 63. A sawtoothed interior wall 70 is located in the rear section of section, and a cam body 50 having sawtoothed edges 52 is disposed to engage said cam face 63. A push-bar 40 is connected to said cam body 50 which can be depressed from said rear section. Thus, in operation, said ink tube tips are lodged in said front section, when said push bar 40 is depressed, said cam body 50 pushes on said cam means 60 along said sawtoothed interior wall, said cam means 60 moves forward towards the front section and said blocking means 62, 62*a* of said cam means 60 engages one of said ink tube joint members 25*a* pushing the one corresponding tube 20*a* forward towards the front section, the tip of said tube passing through said aperture, when said push-bar is again depressed, said cam is also pushed over one tooth and moves back, the tip of one of said tubes 20*a* retracting within said front section, when the push-bar is again pushed, said rotary cam will have turned one tooth and said blocking section 62, 62*a* will then engage said other tube 20*b*, joint member 25*b*, and repeat the sequence. If there are two ink tubes, said blocking means can be on the outside of the rotary cam means. If there are three ink tubes, said rotary cam means 60 may have a central aperture, said blocking means being inside said rotary cam means and disposed to block only one of said joint members.

We claim:

1. A multi-colored ink pen having a casing (1, 2) with front, rear and center sections, and an outer end, said outer end having an aperture to allow passage of an ink reservoir tip therethrough, a push bar at said rear end and at least first and second elongated ink reservoirs (20*a*, 20*b*) in said casing operated by said push bar (40) with rear ends towards the center section and, tips disposed in the vicinity of said outer end; thin elongated joint members (25*a*, 25*b*) with a joint front and rear ends, each of said joint front ends being attached to one of said ink reservoirs rear ends, the improvement therein comprising:

a. rotary cam means (60) in said rear section including a blocking means (62, 62*a*) disposed for contacting said joint rear ends to individually depress one of said joint rear ends to urge out the ink tube to which said one joint is attached, and outer cam ribs (63) with cam faces;

b. a saw tooth interior wall (7) in said casing rear section, a cam body (50) having sawtooth edges (52) disposed to engage said cam faces; and, c. said push bar (40) being connected to said cam body (50), which can be depressed from said rear section, whereby, when said push bar (40) depressed, said cam body (50) pushes on said cam means (60) along said sawtooth interior wall, said cam means (60) moves forward towards the front section and said blocking means (62, 62*a*) of said cam means (60) engages one of said ink reservoir joint members (25*a*) pushing the one corresponding reservoir (20*a*) forwards towards the front section, the tip of said reservoir passing through said aperture, when said push bar is again depressed, said cam also being pushed over one tooth and moves back, the tip of one of said one reservoir (20*a*) retracting within said front section, when the push bar is again pushed, said rotary cam will have turned one tooth and said blocking section (62,

62*a*) will then engage said other reservoir (20*b*), joint member (25*b*) and repeat the sequence.

2. A pen as claimed in claim 1 wherein there are two ink reservoirs, said blocking means is on the outside of said rotary cam means.

3. A pen as claimed in claim 1 wherein there are three ink reservoirs, said rotary cam means (60) having a central aperture, said blocking means being inside said rotary cam means and disposed to block only one of said joint members.

* * * * *